US010746520B1

(12) United States Patent
Hall et al.

(10) Patent No.: US 10,746,520 B1
(45) Date of Patent: Aug. 18, 2020

(54) THERMOMECHANICAL ACTIVE HAZARD MITIGATION CAPSULE

(71) Applicant: Department of the Navy, Indian Head, MD (US)

(72) Inventors: Ian A. Hall, Rockville, MD (US); Edward A. Russo, Charlottesville, VA (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 16/350,263

(22) Filed: Oct. 24, 2018

(51) Int. Cl.
*F42B 39/00* (2006.01)
*F42C 15/36* (2006.01)
*F42B 12/20* (2006.01)

(52) U.S. Cl.
CPC ..... *F42C 15/36* (2013.01); *F42B 12/207* (2013.01)

(58) Field of Classification Search
CPC ..... F42C 15/36; F42B 12/207; F42B 39/20; F02K 9/38
USPC ..... 102/202.1–202.4, 222, 481; 149/19.91
See application file for complete search history.

(56) References Cited

U.S. PATENT DOCUMENTS 4,137,849 A 2/1979 Hontgas et al.
4,843,965 A 7/1989 Merzals
5,044,154 A 9/1991 English, Jr. et al.
5,083,705 A 1/1992 Kuze
5,188,287 A 2/1993 Chamot
5,228,285 A 7/1993 Van Name et al.
5,648,634 A * 7/1997 Avory ..... C06B 33/06 102/202.1
5,786,544 A 7/1998 Gill et al.
6,200,021 B1 3/2001 Mitsutani et al.
6,615,737 B2 9/2003 Bonnel et al.
6,857,658 B2 * 2/2005 Iwai ..... B60R 21/2644 102/531
6,966,264 B2 11/2005 Solberg et al.
7,156,025 B2 * 1/2007 Ostin ..... B60R 21/2644 102/530
7,762,195 B2 7/2010 Friedlander, III et al.
8,113,119 B2 2/2012 Crawford
8,424,455 B2 4/2013 Crawford, II
8,578,855 B2 * 11/2013 Diehl ..... F16L 35/00 102/377
8,789,467 B2 7/2014 Crawford
(Continued)

FOREIGN PATENT DOCUMENTS

EP 0381753 6/1993

*Primary Examiner* — Michael D David
(74) *Attorney, Agent, or Firm* — Fredric J. Zimmerman

(57) ABSTRACT

A thermomechanical safety device includes a body and a capsule valve mounted in the body. A volume of auto-ignition material is disposed in the capsule valve, which is moveable between a rest position and a firing position. A spring engages the capsule valve and the body, and biases the capsule valve towards the rest position. A temperature sensitive actuator engages the capsule valve and the body. The temperature sensitive actuator moves the capsule valve between the rest position and the firing position in response to a change in temperature. The temperature to cause the temperature sensitive actuator to move the capsule valve between the rest position and the firing position is less than the ignition temperature of the auto-ignition material.

16 Claims, 2 Drawing Sheets

(56) References Cited

U.S. PATENT DOCUMENTS

| | | | | |
|---|---|---|---|---|
| 9,482,185 | B1 * | 11/2016 | Borrell | F02K 9/95 |
| 2016/0187111 | A1 * | 6/2016 | Rastegar | F42B 17/00<br>102/438 |

* cited by examiner

THERMOMECHANICAL ACTIVE HAZARD MITIGATION CAPSULE

ORIGIN OF THE INVENTION

The invention described herein was made in the performance of official duties by employees of the Department of the Navy and may be manufactured, used, licensed by or for the Government for any governmental purpose without payment of any royalties thereon.

BACKGROUND

Field of the Invention

This invention is related to a device for preventing propulsive ignition of a rocket motor exposed to a heated ambient or slow cook-off environment. In particular, the invention is related to a mechanism for sensing the heated ambient and triggering a less violent burning of the rocket motor.

Description of the Background

Energetic materials, such as explosives and propellants, pose the extreme hazard of being inadvertently detonated due to unplanned or accidental stimuli, such as increased heat. This hazard is multiplied significantly when these materials are stored in close proximity, as a single unintentional detonation can lead to repetitive, sympathetic detonations. Such unintentional detonations have the potential of destroying not only life and limb, but also the containment structures in which they occur. This potential for destruction is particularly high when these materials are carried aboard oceangoing vessels.

One of the primary dangers from storing rockets or missiles arises not from the explosive charge or warhead, which may be the missile payload, but rather the rocket propellant or rocket motor itself. In particular, fires and other sources of high ambient heat in proximity to rocket motors create a high risk that the motors will prematurely ignite.

Stresses of thermal origin, such as propellant fires and indirect heatings, can result in the pyrotechnic reaction of the munitions, which are subjected to them. Explosive-comprising munition components, such as missile warheads, bomb casings, penetrators, and submarine munitions, can lead to violent blast or detonation reactions because of their high confinement.

Even though the rocket may not be directly exposed to open flame, there is, nevertheless, a substantial danger that the rocket motor will be ignited when it is exposed to high ambient temperatures over a prolonged period of time, for example, where the temperature of the rocket motor or pressure vessel itself gradually reaches a predetermined ignition temperature. Instances of such ambient exposure could readily occur when stockpiles of rockets or rocket motors are exposed to ambient heat or convection heat caused by the presence of flame in the ambient environment. Specifically, such an event may occur when a magazine, which may not be directly subjected to fire, is gradually heated due to a fire in a nearby compartment on board a ship (i.e., slow cook off).

In such a case, if one of the rocket motors should ignite from prolonged exposure to heat, not only can it become a destructive ballistic even if unarmed, in many cases the rocket ignition may trigger events causing the warhead to be armed.

SUMMARY

It is an aspect of the invention to provide an integrated pressure seal and temperature response system that can be attached to the ignitor cup of a rocket motor. The system operates when a specific thermal environment is detected. The system uses a thermostatic wax to sense a heated ambient environment and trigger a less violent burning of the rocket motor. The thermostatic wax provides the motive force to position an auto-ignition pyrotechnic material in order to enable pre-emptive burning of the rocket motor in a less volatile manner during excessive heat conditions. The thermostatic wax and the pyrotechnic material have different initiation temperatures, so a spring enables the system to move the pyrotechnic material back out of line and into a safe position if the thermal environment cools down prior to activation of the pyrotechnic material.

According to an aspect of the invention, a thermomechanical safety device includes a body and a capsule valve mounted in the body. A volume of auto-ignition material is disposed in the capsule valve, which is moveable between a rest position and a firing position. A spring engages the capsule valve and the body, and biases the capsule valve towards the rest position. A temperature sensitive actuator engages the capsule valve and the body. The temperature sensitive actuator moves the capsule valve between the rest position and the firing position in response to a change in temperature. The temperature to cause the temperature sensitive actuator to move the capsule valve between the rest position and the firing position is less than the ignition temperature of the auto-ignition material.

According to an exemplary device herein, a body has a first end and a second end. A wax motor assembly is attached to the first end of the body. The wax motor assembly includes a housing and a plug connected to the housing. The plug has a top surface and a bottom surface and an aperture therethrough, extending from the top surface to the bottom surface. A layer of thermostatic wax is on the top surface of the plug inside the housing. A capsule cap is inside the body. The capsule cap includes a piston located in the aperture and a plate. A capsule valve is connected to the capsule cap. The capsule valve is sealingly engaged with the second end of the body. A spring holds the plate against the bottom surface of the plug. An auto-ignition pellet is inside the capsule valve.

According to another exemplary device herein, a body has a first portion and a second portion, and a ledge formed at the bottom of the first portion. The ledge separates the first portion from the second portion. The second portion includes a valve housing. The body includes a bore extending through the body and the valve housing. The valve housing is formed by a hollow cylindrical sleeve having external threads. The first portion includes a wax motor assembly therein. The wax motor assembly includes a motor housing and a plug connected to the motor housing. The plug has a top surface and a bottom surface, and an aperture extending from the top surface to the bottom surface of the plug. The wax motor assembly further includes a capsule cap. The capsule cap includes a piston located in the aperture and a plate. A layer of thermostatic wax is formed on the top surface of the plug inside the motor housing. The valve housing has a capsule valve disposed therein. The capsule valve is formed by a cylinder with a first end and a second end. The first end is connected to the capsule cap and the second end has a flange across the second end of the cylinder. Gas release ports circumscribe the cylinder adjacent to the flange. A spring is located between the ledge and the plate.

DETAILED DESCRIPTION OF THE INVENTION

Generally, a weapon system contains a warhead, which includes an encased explosive charge, a fusing sub system for activating the charge, and a delivery device, such as a rocket motor. Warheads and rocket motors are usually heavily and totally confined. This confinement causes problems in relation to thermal stimuli, and especially to a slow cook-off. During a slow heating environmental exposure, unintended ignition of the propellant may lead to rupture of the propulsion system. Exemplary embodiments herein disclose thermomechanical safety devices that provide preemptive, controlled burning of the rocket motor under increased temperature environmental conditions.

Figure 1:
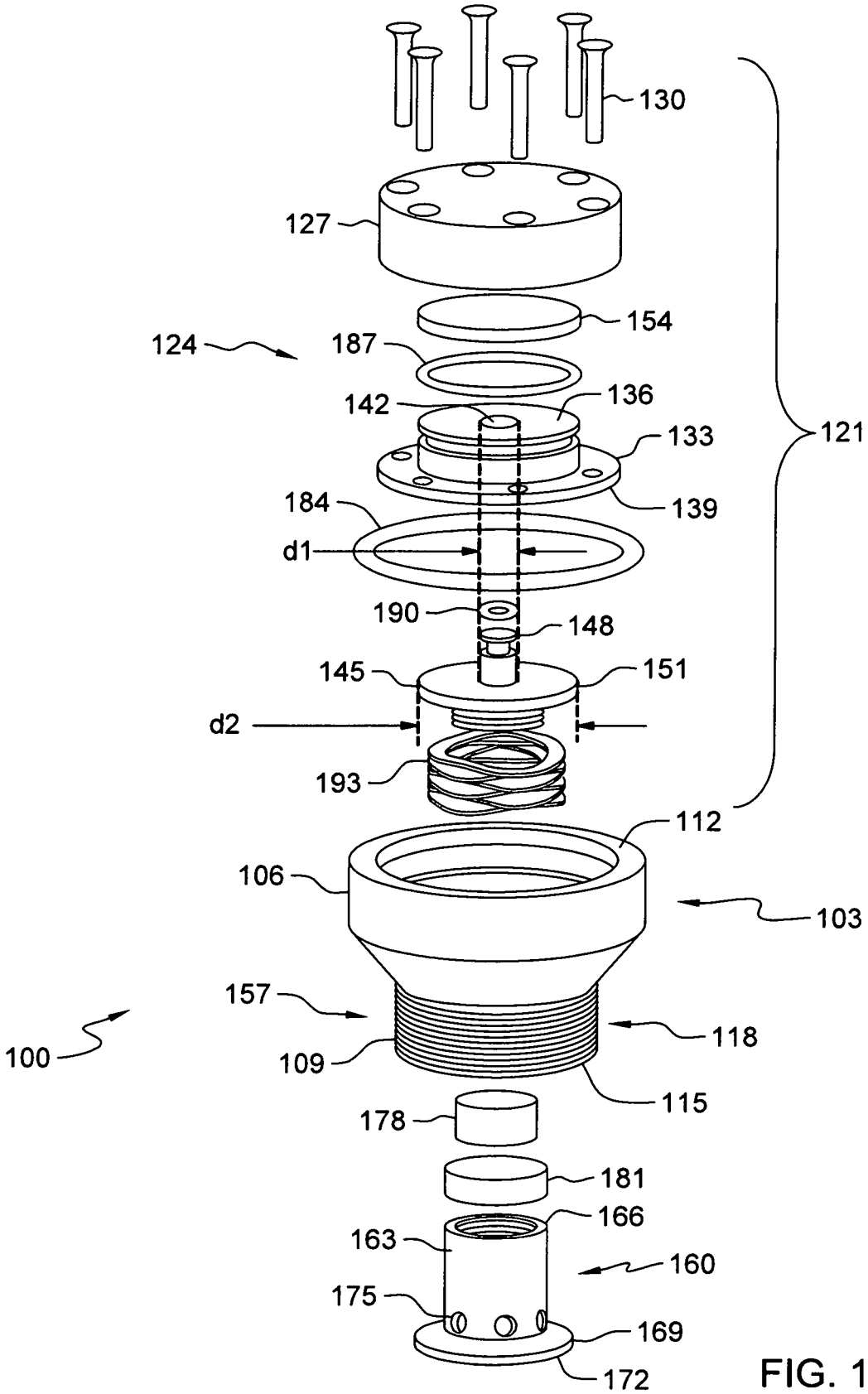
FIG. 1 is an exploded view of a thermomechanical safety device according to devices herein.

Referring to FIG. 1, a thermomechanical safety device, indicated generally as 100, includes a body 103 having a first portion 106 and a second portion 109. The body 103 may be substantially cylindrical. In some embodiments, the body 103 may be made of metal or plastic. A hollow bore extends from the first end 112 to the second end 115 of the body 103. The second portion 109 may include screw threads 118 configured to connect the body 103 to the opening of an ignitor cup for a rocket motor or warhead.

The first portion 106 of the body 103 may include a temperature sensitive actuator, indicated generally as 121. The temperature sensitive actuator 121 may include a wax motor assembly 124 comprising a motor housing 127 attached to the body 103. The motor housing 127 may be attached to the body 103 by appropriate fasteners, such as screws 130. The wax motor assembly 124 also includes a plug 133 connected to the motor housing 127. The plug 133 has a top surface 136 and a bottom surface 139. An aperture 142 extends from the top surface 136 to the bottom surface 139 of the plug 133. The aperture 142 may have a first diameter d1. The wax motor assembly 124 further includes a capsule cap 145. The capsule cap 145 incorporates a piston 148 and a plate 151. The piston 148 has the first diameter d1 and is located in the aperture 142. The plate 151 may have a second diameter d2 and is located adjacent to the bottom surface 139 of the plug 133. The first diameter d1 is smaller than the second diameter d2. A layer of thermostatic wax 154 is formed on the top surface 136 of the plug 133, inside the motor housing 127. The thermostatic wax 154 is of the type that expands on exposure to increased temperature, which actuates the temperature sensitive actuator 121 in response to the temperature increasing above a selected threshold.

The second portion 109 of the body 103 may define a valve housing 157 having a capsule valve 160 disposed therein. The capsule valve 160 is formed by a cylinder 163 with a first end 166 and a second end 169. The first end 166 is connected to the capsule cap 145. The capsule valve 160 may be connected to the capsule cap 145 by any appropriate means, such as by a threaded connector. The second end 169 of the cylinder 163 has a flange 172 across the second end 169 of the cylinder 163. A plurality of gas release ports 175 circumscribe the cylinder 163 adjacent to the flange 172. A volume of auto-ignition material, such as auto-ignition pellet 178, may be located inside the capsule valve 160. The auto-ignition pellet 178 may be of the type that self-ignites at a temperature above a selected threshold, such as above about 185° C. The volume of auto-ignition material is selected to insure substantially complete consumption of the rocket motor igniter without an undue increase in pressure. In some exemplary embodiments, the auto-ignition pellet 178 may be held in the capsule valve 160 by auto-ignition tape 181 or other appropriate means.

The temperature sensitive actuator 121 may include several O-rings to seal parts of the wax motor assembly 124. A first static O-ring 184 forms a seal between the outside of the motor housing 127 and the body 103. A second static O-ring 187 forms a seal between the plug 133 and the inside of the motor housing 127. A small dynamic O-ring 190 may be installed on the end of the piston 148 to be slidably engaged with the walls of the aperture 142.

Figure 2:
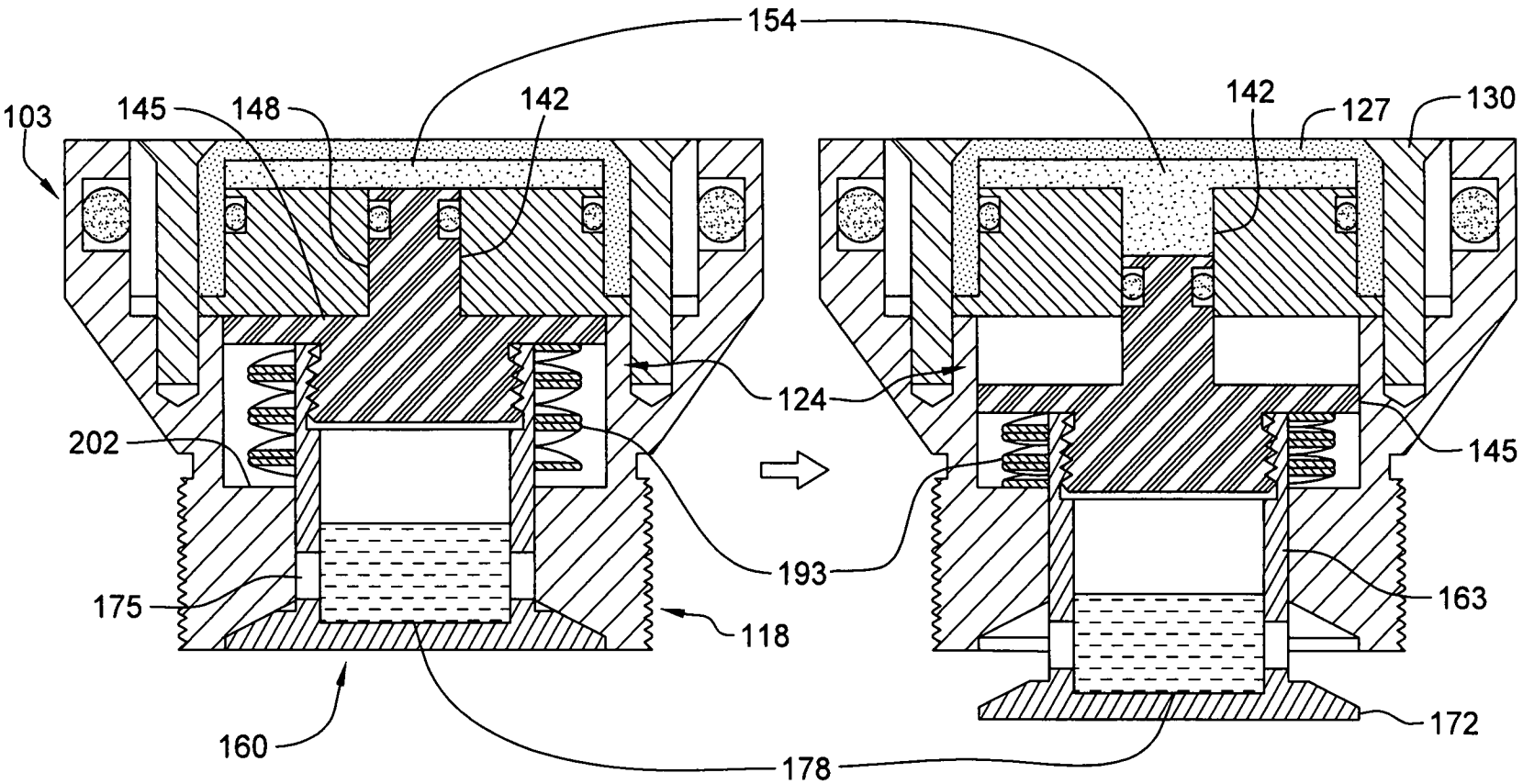
FIG. 2 is a cut-away view of a thermomechanical safety device showing operation positioning according to devices herein.

Referring to FIG. 2, the capsule valve 160 is moveable between a rest position (shown on the left side of FIG. 2) and a firing position (shown on the right side of FIG. 2). The body 103 has a ledge 202 formed inside the body 103 at the bottom of the first portion 106. The ledge 202 separates the first portion 106 from the second portion 109. A spring 193 (FIG. 1) is located between the ledge 202 and the plate 151 of the capsule cap 145. The spring 193 may be any appropriate biasing mechanism, which may include a compression spring, such as a wave spring. The spring 193 holds the plate 151 against the bottom surface 139 of the plug 133 and engages the capsule valve 160 with the body 103. The spring 193 biases the capsule valve 160 towards the rest position. The temperature sensitive actuator 121 engages the capsule valve 160 with the body 103. The temperature sensitive actuator 121 moves the capsule valve 160 between the rest position and the firing position in response to a change in temperature. When the ambient temperature rises in excess of a predetermined threshold of the temperature sensitive actuator 121, the thermostatic wax 154 expands. This forces the thermostatic wax 154 to press against the piston 148. As the force of the thermostatic wax 154 overcomes the force of the spring 193, the capsule cap 145 moves downward, thereby opening the capsule valve 160 to the firing position, as shown on the right side of FIG. 2. When the ambient temperature cools, the thermostatic wax 154 contracts. Then, the spring 193 returns the capsule valve 160 to the rest position, as shown on the left side of FIG. 2.

In the rest position (shown on the left side of FIG. 2), the capsule valve 160 is sealingly engaged with the second end 115 of the body 103. In the firing position (shown on the right side of FIG. 2), the capsule valve 160 is displaced from the second end 115 of the body 103, such that the gas release ports 175 are exposed. According to embodiments herein, the temperature to cause the temperature sensitive actuator 121 to move the capsule valve 160 between the rest position and the firing position is less than the ignition temperature of the auto-ignition material.

When exposed to a slow cook off threat, e.g., elevated ambient temperature, the temperature sensitive actuator 121 moves the capsule valve 160 between the rest position and the firing position, as shown in FIG. 2. As ambient temperature continues to increase, the auto-ignition pellet 178 ignites and the resultant hot gases escape through the gas release ports 175, which enter the ignitor cup and, in turn, ignite the main propellant of a gas propulsion system, such as a rocket motor or warhead, especially those with low auto-ignition temperatures, at a lower temperature than its auto-ignition temperature and hence produces a reduced violence reaction and passes the slow cook off threat by reducing the reaction severity of the slow cook-off event.

If the slow cook off threat is reduced prior to firing of the auto-ignition pellet 178 the thermomechanical safety device 100 can "re-safe". For example, the dynamic forces between the spring 193 and the thermostatic wax 154 enables the system to move the pyrotechnic material back out of line and into a safe position if the rocket motor should cool down (if, for instance, it was removed from the heated environment before the cook-off event). This arrangement is an additional safety mechanism that is built in to eliminate any additional hazard that the pyrotechnic might introduce should the motor return to a safe environment.

The invention has been described with references to specific embodiments. While particular values, relationships, materials, and steps have been set forth for purposes of describing concepts of the invention, it will be appreciated by persons skilled in the art that numerous variations and/or modifications may be made to the invention as shown in the disclosed embodiments without departing from the spirit or scope of the basic concepts and operating principles of the invention as broadly described. It should be recognized that, in the light of the above teachings, those skilled in the art could modify those specifics without departing from the invention taught herein. Having now fully set forth certain embodiments and modifications of the concept underlying the present invention, various other embodiments as well as potential variations and modifications of the embodiments shown and described herein will obviously occur to those skilled in the art upon becoming familiar with such underlying concept. It is intended to include all such modifications, alternatives, and other embodiments insofar as they come within the scope of the appended claims or equivalents thereof. It should be understood, therefore, that the invention might be practiced otherwise than as specifically set forth herein. Consequently, the present embodiments are to be considered in all respects as illustrative and not restrictive.

The terminology used herein is for the purpose of describing particular systems and methods only and is not intended to be limiting of this disclosure. As used herein, the singular forms "a", "an", and "the" are intended to include the plural forms as well, unless the context clearly indicates otherwise. It will be further understood that the terms "comprises", "comprising", "includes", and/or "including", when used in this specification, specify the presence of stated features, integers, steps, operations, elements, and/or components, but do not preclude the presence or addition of one or more other features, integers, steps, operations, elements, components, and/or groups thereof. Further, the terms "automated" or "automatically" mean that once a process is started (by a machine or a user), one or more machines perform the process without further input from any user.

The corresponding structures, materials, acts, and equivalents of all means or step plus function elements in the claims below are intended to include any structure, material, or act for performing the function in combination with other claimed elements as specifically claimed. The descriptions of the various embodiments herein have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others of ordinary skill in the art to understand the embodiments disclosed herein.

For example, terms such as "right", "left", "vertical", "horizontal", "top", "bottom", "upper", "lower", "under", "below", "underlying", "over", "overlying", "parallel", "perpendicular", etc., as used herein, are understood to be relative locations as they are oriented and illustrated in the drawings (unless otherwise indicated). Terms such as "touching", "on", "in direct contact", "abutting", "directly adjacent to", etc., mean that at least one element physically contacts another element (without other elements separating the described elements).

Finally, any numerical parameters set forth in the specification and attached claims are approximations (for example, by using the term "about") that may vary depending upon the desired properties sought to be obtained by the present invention. At the very least, and not as an attempt to limit the application of the doctrine of equivalents to the scope of the claims, each numerical parameter should at least be construed in light of the number of significant digits and by applying ordinary rounding.

What is claimed is:

1. A thermomechanical safety device, comprising:

a body;

a capsule valve being mounted in said body, a volume of auto-ignition material being disposed in said capsule valve, said capsule valve is moveable between a rest position and a firing position;

a spring engaging said capsule valve and said body, said spring biases said capsule valve towards the rest position; and a temperature sensitive actuator engaging said capsule valve and said body, said temperature sensitive actuator moves said capsule valve between the rest position and the firing position in response to a change in temperature, wherein, the temperature to cause said temperature sensitive actuator to move said capsule valve between the rest position and the firing position is less than the ignition temperature of said auto-ignition material.

2. The thermomechanical safety device according to claim 1, wherein said body is configured to connect to an ignitor cup for a rocket motor or warhead.

3. The thermomechanical safety device according to claim 2, said body further comprising screw threads for connecting said body to said ignitor cup.

4. The thermomechanical safety device according to claim 1, said temperature sensitive actuator further comprising:

a wax motor assembly comprising:

a motor housing, a plug connected to said motor housing, said plug comprises a top surface and a bottom surface, and includes an aperture extending from said top surface to said bottom surface of said plug, a capsule cap connected to said capsule valve, said capsule cap comprises a piston located in said aperture and a plate, and a layer of thermostatic wax formed on the top surface of said plug inside said motor housing.

5. The thermomechanical safety device according to claim 1, said capsule valve further comprising:

a cylinder having a first end and a second end, said first end being connected to said temperature sensitive actuator, said second end comprising a flange across said second end of said cylinder.

6. The thermomechanical safety device according to claim 5, said capsule valve further comprises gas release ports to circumscribe said cylinder adjacent to said flange.

7. The thermomechanical safety device according to claim 1, said body further comprising a first portion and a second portion and a ledge formed at the bottom of the first portion, the ledge separates the first portion from the second portion; and a bore extending through said body, wherein the spring is positioned on said ledge.

8. A device, comprising:

a body comprising a first end and a second end;

a wax motor assembly being attached to said first end of said body, said wax motor assembly comprising:

a housing, a plug connected to said housing, said plug comprising a top surface and a bottom surface and having an aperture therethrough extending from said top surface to said bottom surface, and a layer of thermostatic wax on the top surface of said plug inside said housing; a capsule cap inside said body, said capsule cap comprises a piston located in said aperture and a plate;

a capsule valve connected to said capsule cap, said capsule valve being sealingly engaged with the second end of said body;

a spring holding said plate against the bottom surface of said plug; and an auto-ignition pellet being situated inside said capsule valve, wherein said capsule valve is moveable between a rest position and a firing position by operation of said wax motor assembly, in response to a change in temperature, wherein the temperature to cause said wax motor assembly to move said capsule valve between the rest position and the firing position is less than the ignition temperature of the auto-ignition pellet.

9. The device according to claim 8, wherein said body is configured to connect to an ignitor cup for a rocket motor or warhead.

10. The device according to claim 9, said body further comprising screw threads for connecting said body to said ignitor cup.

11. The device according to claim 8, said capsule valve further comprising:

a cylinder having a first end and a second end, said first end being connected to said wax motor assembly, said second end comprising a flange across said second end of said cylinder, and gas release ports circumscribing said cylinder adjacent to said flange.

12. The device according to claim 8, said body further comprising a first portion and a second portion and a ledge formed at the bottom of the first portion, the ledge separates the first portion from the second portion, and a bore extending through said body, wherein the spring is positioned on said ledge.

13. A device, comprising:

a body having a first portion and a second portion, and a ledge being formed at the bottom of said first portion, wherein said ledge separates said first portion from said second portion, wherein said second portion comprises a valve housing, wherein said body comprises a bore to extend through the body and the valve housing, wherein said valve housing comprises a hollow cylindrical sleeve having external threads, wherein the first portion includes a wax motor assembly therein, wherein said wax motor assembly comprises a motor housing, a plug connected to said motor housing, said plug comprises a top surface and a bottom surface, and the plug includes an aperture extending from the top surface to the bottom surface of said plug, and a capsule cap, said capsule cap comprises a piston located in the aperture and a plate, wherein a layer of thermostatic wax is formed on the top surface of said plug inside said motor housing;

wherein said valve housing includes a capsule valve disposed therein, said capsule valve comprises a cylinder with a first end and a second end, said first end is connected to said capsule cap and said second end comprises a flange across said second end of said cylinder, and gas release ports circumscribes the cylinder adjacent to the flange; and a spring being located between the ledge and the plate;

an auto-ignition pellet inside said capsule valve;

wherein said wax motor assembly moving said capsule valve between a rest position and a firing position in response to a change in temperature, wherein the temperature to cause said wax motor assembly to move said capsule valve between the rest position and the firing position is less than the ignition temperature of said auto-ignition pellet.

14. The device according to claim 13, wherein said body is configured to connect to an ignitor cup for a rocket motor or warhead.

15. The device according to claim 14, said body further comprising screw threads for connecting said body to said ignitor cup.

16. The device according to claim 13, wherein said capsule valve is moveable between a rest position and a firing position by operation of said wax motor assembly.

* * * * *